United States Patent [19]

Beauchamp

[11] 4,025,918

[45] May 24, 1977

[54] ALARM SYSTEM AND REMOTE MONITOR PANEL

[76] Inventor: Lee R. Beauchamp, 11715 Innsbury, Houston, Tex. 77016

[22] Filed: Feb. 20, 1976

[21] Appl. No.: 659,842

[52] U.S. Cl. ..... 340/409; 340/213.1

[51] Int. Cl.[2] ..... G08B 25/00

[58] Field of Search ..... 340/164 R, 164 A, 213 R, 340/213.1, 409, 410, 412, 421

[56] References Cited

UNITED STATES PATENTS

| | | | |
|---|---|---|---|
| 2,840,804 | 6/1958 | Rodgers | 340/213.1 |
| 2,917,731 | 12/1959 | Rodgers | 340/213.1 |
| 2,934,752 | 4/1960 | Arrasmith | 340/213.1 |

*Primary Examiner*—Alvin H. Waring
*Attorney, Agent, or Firm*—Ranseler O. Wyatt

[57] ABSTRACT

An alarm system remote monitor panel having a series of control units, each unit being provided with a light cell, diodes and a coil so that when a remote sensor triggers an alarm, the light will be illuminated and the audio unit activated. The audio may be disconnected at the monitor panel, and the light turned off at the sensor.

5 Claims, 3 Drawing Figures

Fig. 1
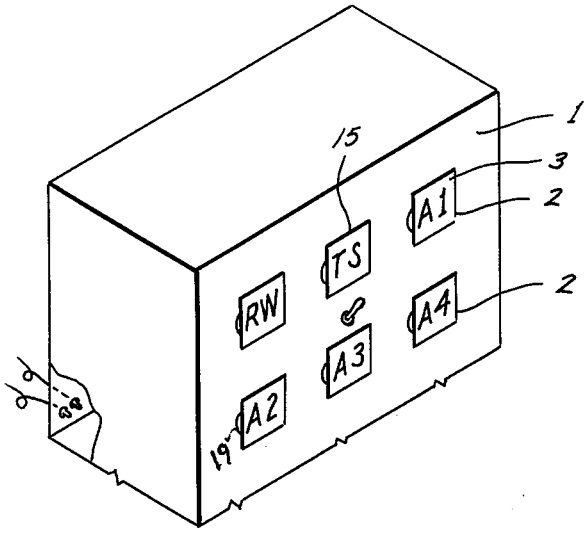
Fig. 2
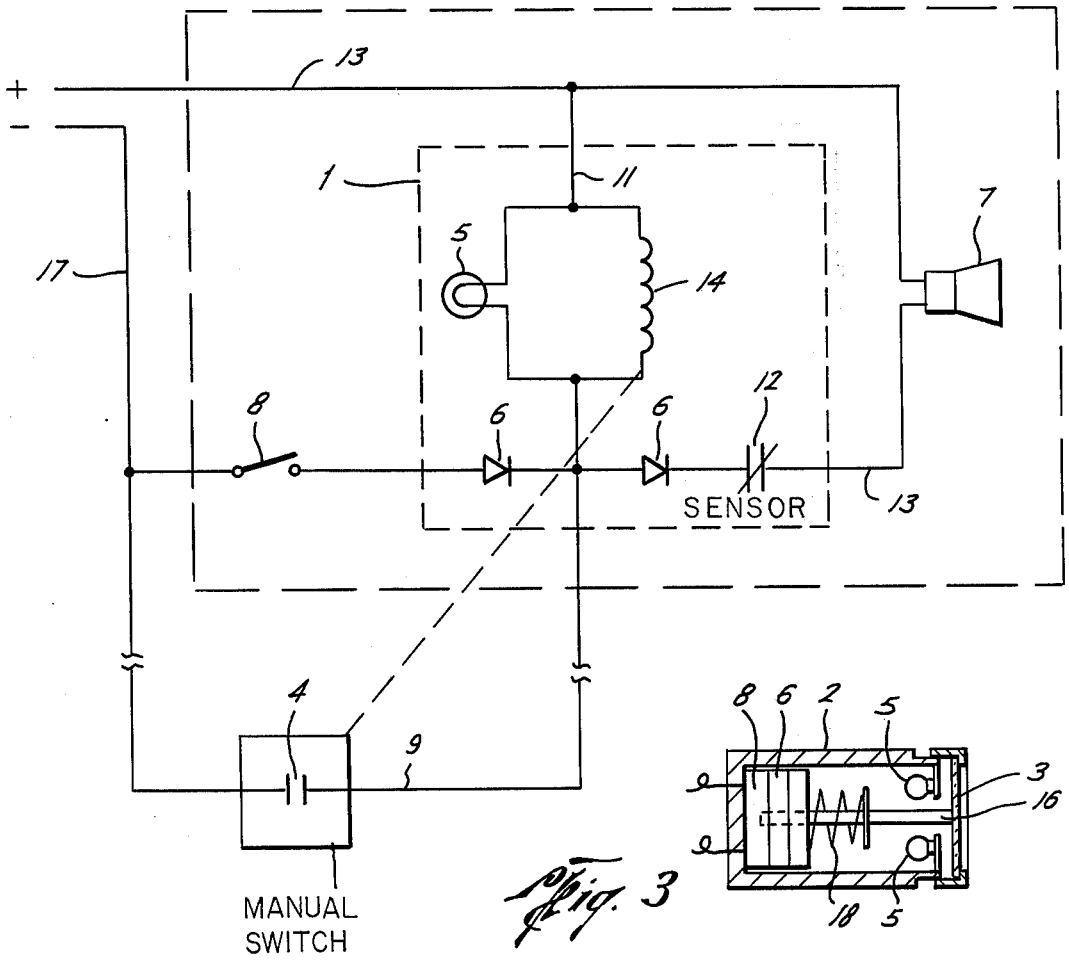
Fig. 3

ALARM SYSTEM AND REMOTE MONITOR PANEL

BACKGROUND OF THE INVENTION

An alarm system in present use is usually provided with a remote monitor panel, where the sensor illuminates a signal light and activates an audio alarm. The switch at the monitor panel will deactivate the signal and the warning is lost. The need for a simple circuit to deactivate the audio means, and retain the visible signal until manually disconnected at the sensor location is obvious, particularly in the case of stationary engines where a warning of excessive heat, and the like, requires assurance that the attendant has remedied the trouble before the unit is completely deactivated.

SUMMARY OF THE INVENTION

A remote control panel for alarm systems having a unit for each sensor containing an audio control switch and a light and a sensor at a remote location and a switch at such location for turning off the light when the trouble has been remedied.

BRIEF DESCRIPTION OF THE DRAWINGS

FIG. 1 is a side elevational perspective view of the panel board.

FIG. 2 is a circuit diagram of the units employed, and

FIG. 3 is an enlarged view of one of the units mountable in the panel board.

DESCRIPTION OF THE PREFERRED EMBODIMENT

In the drawings the numeral 1 designates a panel housing in which the respective units 2, 2 are mounted. Each unit consists of a transparent plate 3 opposite the outer face of which is mounted a bank of light sockets, in which the lights 5, 5 are mounted. These lights are preferably in increments of four, so that the possibility of all of these lights being burned out at the same time is quite remote, and consequently the plate 3 will be illuminated when the alarm is activated. A spring loaded shaft 16 extends from the panel plate 3 to the switch 8, which is a solenoid operated switch actuated by the coil 14 when sensor 12 is activated, and which is normally in open position and movable to open position, once it has been closed, only by deactivation of the solenoid, manually, by operation of a remote switch 4. Adjacent the switch 8 are the diodes 6, 6 which give directional control to the circuit passing therethrough to the alarm means 7 and sensor 12.

The units 2, 2 are removably mounted in the panel board 1 and normally the plates 3 are flush with the surface of the panel board 1, with indentations at the openings in the panel board to receive the units, which provide means for a finger grip on the sides of the units for easy removal. The switch 8 is manually opened, and the sensor 12, of any desired character, is located remotely from the panel 1, such on a water jacket of a stationary engine (not shown) and is designed to be activated at a predetermined condition, as by overheating of the water in the water jacket, and to transmit a signal to the solenoid 14, activating the solenoid which will close the switch 4 and illuminate the lights 5, 5, and activate the audio alarm 7.

The attendant on duty at the location of the panel board 1 may then silence the alarm by pressing on the plate 2, which will open the switch 8, breaking the circuit to the alarm 7. The lights 5, 5 however, remain on, through the lines 11, 9, so that the attendant knows the cause of the alarm has not been corrected. When the attendant goes to the area of the sensor 12, and corrects the condition causing the alarm, such as supplying water to the cooling jacket, the switch 4, located in the area of the sensor 12, may be manually opened, to turn off the lights, indicating a correction of the trouble. By returning to the panel board and depressing the plate 2 of the pertinent unit, the switch 8 is again closed and the alarm reset.

The circuit through each unit 2 is through line 17, to lines 9, 13. The switch 8 is closed by manually depressing the panel 2, moving the shaft 16 against the pressure of the spring 18, and against the switch 8, closing the circuit to the sensor 12 through lines 13 and alarm 7 in line 13. The diodes 6, 6 maintain the circuit in clockwise direction only. The switch 4, located remotely from the panel 1, is open until the sensor 12 activates the solenoid 14, closing the switch 4 and illuminating the lights 5, 5, the circuit being through lines 17, 9, 11 and 13. When the sensor activates the solenoid, both the alarm and the lights will be activated. Depressing the panel plate 3 opens the switch 8, breaking the circuit through the sensor and alarm, but the circuit through lines 17, 9, 11, 13 continues, leaving the lights 5 illuminated. When the attendant finds and corrects the fault, the switch 4 is manually opened, turning off the lights, and upon return to the panel board, the plate 3 is again depressed closing the switch 8, and resetting the alarm system.

As many units may be installed in the panel board 1 as desired, each having the dual circuits above described, all parts, other than the sensor and the remote switch, being located in the unit mounted in the panel board. Where trouble is experienced in the individual unit, it may be quickly and easily replaced, identations 19 in the unit housing opening providing space for a finger grip on the unit to withdraw same from the panel board. Terminal connections as 20 are mounted on the rear of the housing 1 to receive the wires from a source of power and leading to the remote sensor 12, alarm 7 and switch 4.

A testing set 15, having all the elements of the unit above described, may be mounted in the panel board 1, and a switch 16, simulating a remote switch, provided in the panel board 1, so that the circuits may be tested at the panel board.

What I claim is:

1. An alarm system having a panel board, control units in said panel board, each unit having a sensor activated audio alarm, illuminating means and a sensor mounted in an electrical circuit, a line connected into said circuit and having its terminals mountable in said panel board, each control unit having a transparent plate, and having said illuminating means behind said plate, a switch in said unit having means for manually deactivating said alarm, a shaft extending from said plate to said switch and movable by pressure against said plate to actuate said switch, and circuit directional control means between said switch and said sensor, another line having its terminals in said unit, and having a remote switch closed upon activation of said alarm and illuminating said illuminating means and manually reopened to reset the unit, and deactivate said illuminating means.

2. The device defined in claim 1 wherein said switch in said units may be opened to deactivate the audio alarm, and said remote switch may be manually opened to deactivate said illuminating means.

3. The device defined in claim 1 wherein said sensor and said audio alarm means are in one circuit and said illuminating means is in another parallel circuit, said switch in said unit being manually movable to break the circuit to said audio alarm and a remote switch located in the sensor area for breaking the circuit through said illuminating means.

4. The device defined in claim 1 wherein a testing unit is mounted in said panel board having a manually actuated second switch mounted on said panel board to simulate a remote switch.

5. The device defined in claim 1 wherein said circuit consist of a line leading from a source of power, directional control diodes in said line maintaining the current flow in one direction only, the other line passing through said remote switch so that the flow of power to the sensor and audio alarm may be broken while the flow through the illuminating means and solenoid will continue until broken by the manual opening of the remote switch.

* * * * *